US009915146B2

(12) United States Patent
Logan et al.

(10) Patent No.: US 9,915,146 B2
(45) Date of Patent: Mar. 13, 2018

(54) FLUID PRESSURE PULSE GENERATING APPARATUS WITH PRIMARY SEAL ASSEMBLY, BACK UP SEAL ASSEMBLY AND PRESSURE COMPENSATION DEVICE AND METHOD OF OPERATING SAME

(71) Applicant: Evolution Engineering Inc., Calgary (CA)

(72) Inventors: Aaron W. Logan, Calgary (CA); Justin C. Logan, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 340 days.

(21) Appl. No.: 14/744,900

(22) Filed: Jun. 19, 2015

(65) Prior Publication Data

US 2015/0285067 A1 Oct. 8, 2015

Related U.S. Application Data

(63) Continuation of application No. PCT/CA2013/051006, filed on Dec. 20, 2013.
(Continued)

(51) Int. Cl.
*E21B 47/18* (2012.01)
*E21B 21/08* (2006.01)
(Continued)

(52) U.S. Cl.
CPC ..... *E21B 47/18* (2013.01); *E21B 21/08* (2013.01); *E21B 21/10* (2013.01);
(Continued)

(58) Field of Classification Search
CPC ..... E21B 47/18; E21B 21/08; E21B 47/182; E21B 47/185; E21B 47/187
See application file for complete search history.

(56) References Cited

U.S. PATENT DOCUMENTS 4,876,672 A 10/1989 Petermann et al.
5,119,344 A * 6/1992 Innes ..... E21B 47/182 367/84
(Continued)

FOREIGN PATENT DOCUMENTS

CA 2551316 12/2007
GB 2156915 A 10/1985
(Continued)

OTHER PUBLICATIONS

Extended European Search Report dated Jul. 18, 2016, in 15177786.6.
(Continued)

*Primary Examiner* — Kenneth L Thompson
(74) *Attorney, Agent, or Firm* — Hovey Williams LLP

(57) ABSTRACT

The embodiments described herein generally relate to a fluid pressure pulse generating apparatus with a primary seal assembly, back up seal assembly and pressure compensation device. The pressure compensation device comprises a membrane support and a longitudinally extending membrane system. The membrane support has a longitudinally extending bore therethrough for receiving a driveshaft of the fluid pressure pulse generating apparatus. The longitudinally extending membrane system comprising a longitudinally extending outer membrane sleeve and a longitudinally extending inner membrane sleeve with the inner membrane sleeve positioned inside the outer membrane sleeve. The membrane system is sealed to the membrane support to allow flexing of the membrane system in response to fluid pressure on either an inner longitudinal surface of the membrane system or an outer longitudinal surface of the membrane system and to prevent fluid on the inner longitudinal surface mixing with fluid on the outer longitudinal surface.

39 Claims, 7 Drawing Sheets

Related U.S. Application Data

(60) Provisional application No. 61/745,206, filed on Dec. 21, 2012.

(51) Int. Cl.
*E21B 21/10* (2006.01)
*E21B 43/119* (2006.01)
*E21B 47/01* (2012.01)

(52) U.S. Cl.
CPC ..... *E21B 43/1195* (2013.01); *E21B 47/011* (2013.01); *E21B 47/187* (2013.01)

(56) References Cited

U.S. PATENT DOCUMENTS

| | | | | |
|---|---|---|---|---|
| 5,182,731 | A * | 1/1993 | Hoelscher | E21B 47/18 367/84 |
| 6,714,138 | B1 * | 3/2004 | Turner | E21B 47/18 340/854.3 |
| 6,970,398 | B2 | 11/2005 | Lavrut et al. | |
| 7,564,741 | B2 | 7/2009 | Pratt et al. | |
| 8,203,908 | B2 | 6/2012 | Pratt et al. | |
| 9,133,950 | B2 * | 9/2015 | Gopalan | E21B 47/187 |
| 9,476,296 | B2 * | 10/2016 | Logan | E21B 47/187 |
| 9,528,370 | B2 * | 12/2016 | Logan | E21B 47/187 |
| 2005/0199423 | A1 | 9/2005 | Moriarty | |
| 2005/0231383 | A1 | 10/2005 | Pratt et al. | |
| 2007/0008377 | A1 | 1/2007 | Jia et al. | |
| 2009/0133930 | A1 | 5/2009 | Thorp et al. | |
| 2012/0127829 | A1 | 5/2012 | Sitka | |

FOREIGN PATENT DOCUMENTS

| | | |
|---|---|---|
| GB | 2411676 A | 9/2005 |
| WO | 2005084281 | 9/2005 |
| WO | 2006130606 | 12/2006 |
| WO | 2010138961 | 12/2010 |
| WO | 2012130936 | 10/2012 |
| WO | 2012145637 | 10/2012 |

OTHER PUBLICATIONS

Extended European Search Report dated Jul. 18, 2016, in 15177784.4.

Extended European Search Report dated Jul. 19, 2016, in 13866031.1.

EP Search Report dated Feb. 22, 2016, in EP 15177783.6 filed Dec. 20, 2013.

International Search Report and Written Opinion dated Mar. 24, 2014, in PCT/CA2013/051006 filed Dec. 20, 2013.

EP Search Report dated Feb. 22, 2016, in EP 13866031.1, 6 pages.

EP Search Report dated Feb. 22, 2016, in EP 15177784.4, 9 pages.

* cited by examiner

FLUID PRESSURE PULSE GENERATING APPARATUS WITH PRIMARY SEAL ASSEMBLY, BACK UP SEAL ASSEMBLY AND PRESSURE COMPENSATION DEVICE AND METHOD OF OPERATING SAME

RELATED APPLICATIONS

This application is a continuation of International Application No. PCT/CA2013/051006, filed Dec. 20, 2013, which claims the benefit of U.S. Provisional Patent Application No. 61/745,206 filed Dec. 21, 2012, both of which are hereby incorporated by reference in their entireties.

FIELD

This invention relates generally to downhole drilling, such as measurement-while-drilling (MWD), including a fluid pressure pulse generating apparatus with a primary seal assembly, back up seal assembly and pressure compensation device, such as a mud pulse telemetry apparatus, and methods of operating such apparatus.

BACKGROUND

The recovery of hydrocarbons from subterranean zones relies on the process of drilling wellbores. The process includes drilling equipment situated at surface, and a drill string extending from the surface equipment to the formation or subterranean zone of interest. The drill string can extend thousands of feet or meters below the surface. The terminal end of the drill string includes a drill bit for drilling (or extending) the wellbore. In addition to this conventional drilling equipment, the system also relies on some sort of drilling fluid, in most cases a drilling "mud" which is pumped through the inside of the pipe, which cools and lubricates the drill bit and then exits out of the drill bit and carries rock cuttings back to surface. The mud also helps control bottom hole pressure and prevent hydrocarbon influx from the formation into the wellbore which can potentially cause a blow out at surface.

Directional drilling is the process of steering a well away from vertical to intersect a target endpoint or follow a prescribed path. At the terminal end of the drill string is a bottom-hole-assembly ("BHA") which comprises 1) a drill bit; 2) a steerable downhole mud motor of rotary steerable system; 3) sensors of survey equipment (Logging While Drilling (LWD) and/or Measurement-while-drilling (MWD)) to evaluate downhole conditions as well depth progresses; 4) equipment for telemetry of data to surface; and 5) other control mechanisms such as stabilizers or heavy weight drill collars. The BHA is conveyed into the wellbore by a metallic tubular.

As an example of a potential drilling activity, MWD equipment is used to provide downhole sensor and status information to surface in a near real-time mode while drilling. This information is used by the rig crew to make decisions about controlling and steering the well to optimize the drilling speed and trajectory based on numerous factors, including lease boundaries, locations of existing wells, formation properties, and hydrocarbon size and location. This can include making intentional deviations from an originally-planned wellbore path as necessary based on the information gathered from the downhole sensors during the drilling process. The ability to obtain real time data during MWD allows for a relatively more economical and more efficient drilling operation.

Known MWD tools contain essentially the same sensor package to survey the well bore but the data may be sent back to surface by various telemetry methods. Such telemetry methods include but are not limited to the use of hardwired drill pipe, acoustic telemetry, use of fibre optic cable, Mud Pulse (MP) telemetry and Electromagnetic (EM) telemetry. The sensors are usually located in an electronics probe or instrumentation assembly contained in a cylindrical cover or housing, located near the drill bit.

Mud Pulse telemetry involves creating pressure waves in the drill mud circulating inside the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulses or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat to ensure it completely closes the bypass; the impact can lead to mechanical and abrasive wear and failure. Valves that use a controlled restriction within the circulating mud stream create a positive pressure pulse. Some valves are hydraulically powered to reduce the required actuation power typically resulting in a main valve indirectly operated by a pilot valve. The pilot valve closes a flow restriction which actuates the main valve to create a pressure drop. Pulse frequency is typically governed by pulse generating motor speed changes. The pulse generating motor requires electrical connectivity with the other elements of the MWD probe such as the battery stack and sensors.

In mud pulser systems, as well as in other downhole tools, the pulse generating motor driveline system is subjected to extreme pressure differentials of about 20,000 psi between the external and internal aspects of the tool. To accommodate this large pressure differential, the borehole drilling fluid is allowed access to areas of the tool which are positioned on one side of a compensation mechanism. Pressure is equalized on the other side of the pressure compensation mechanism within the tool using clean, non-drilling fluid such as hydraulic fluid or silicon oil. Various systems have been used to provide pressure compensation including metallic bellows, rubber compensation membranes, and piston compensations with springs. Given the large temperature differentials from surface to downhole, especially in colder drilling climates, there is a high chance of temperature related failures for MWD tool components, in particular rubber membranes used for pressure compensation.

A pressure compensating device is described in WO 2012/130936 which utilizes pistons and fluid to provide pressure compensation via a dual section chamber within a housing. The device allows fluid communication through borehole ports to prevent collapse or bulging of the compensation device resulting from thermal expansion of the hydraulic fluid contained in one of the sections of the chamber. A different pressure compensating device is described in WO 2010/138961, which includes a metal membrane that can compensate for large oil volumes. The metal is capable of elastic deformation and has a shape chosen to optimize such deformation in a desired manner to compensate for the temperature and pressure effects experienced in downhole conditions. U.S. Pat. No. 8,203,908 describes a mud pulser system in which the spline shaft is surrounded by lubricating fluid which is pressurized against the downhole hydrostatic pressure using a bellows style pressure compensator. In addition to the bellows seal, the system has a dual seal which maintains the integrity of the lubrication chamber during operation and during replacement of the bellows seal for maintenance.

During MP telemetry the operation of a mud pulser can cause wear and breakdown of a seal which fluidly seals the rotating driveshaft of the mud pulser from the external drilling mud. The motor of the mud pulser is typically enveloped in lubricating oil which is contained in the pulser housing by the seal. With time, oil tends to leak out and drilling mud tends to leak in through the worn seal. This requires replacement of the seal before any substantial amount of mud leaks in. Mud within the motor housing is detrimental to the operation of the motor, bearings and gearbox, and these components will typically be destroyed if a substantial amount of drilling mud enters the motor housing.

Though seals are relatively simple in design and are used extensively in tools for directional drilling, there are a variety of downhole effects related to the vibration, pressure differential and temperature shocks that can cause seal failure. The seals play a vital role in maintaining the integrity of the mud pulse devices. For example, in rotor/stator configurations that use a blade style rotor, there is a small gap between the rotor blades and the stator. Where the driveshaft exits the stator to connect with the rotor, a seal is typically positioned at the shaft gap to prevent drilling mud ingression into driveline components. The seal is subject to high degrees of abrasion due to turbulence of the mudflow within the small gap between the rotor and stator faces; as such the seal is prone to wear and failure. Failure of the seal leads to the driveline components coming in contact with the drilling fluid which is detrimental to operation.

SUMMARY

According to one aspect of the present disclosure, there is provided a pressure compensation device for a downhole fluid pressure pulse generating apparatus. The pressure compensation device comprises a membrane support and a longitudinally extending membrane system. The membrane support has a longitudinally extending bore therethrough for receiving a driveshaft of the fluid pressure pulse generating apparatus. The longitudinally extending membrane system comprises a longitudinally extending outer membrane sleeve and a longitudinally extending inner membrane sleeve with the inner membrane sleeve positioned inside the outer membrane sleeve. The membrane system is sealed to the membrane support to allow flexing of the membrane system in response to fluid pressure on either an inner longitudinal surface of the membrane system or an outer longitudinal surface of the membrane system and to prevent fluid on the inner longitudinal surface mixing with fluid on the outer longitudinal surface. The membrane system may further comprise at least one longitudinally extending thermally resistive layer positioned between the inner membrane sleeve and the outer membrane sleeve. The inner membrane sleeve may be sealed to the membrane support or both the inner membrane sleeve and the outer membrane sleeve may be sealed to the membrane support. The membrane system may further comprise at least one additional membrane sleeve positioned between the inner membrane sleeve and the outer membrane sleeve.

According to another aspect of the present disclosure, there is provided a back up seal assembly for a fluid pressure pulse generating apparatus having a primary seal. The back up seal assembly comprises a housing with a longitudinally extending bore therethrough for receiving a driveshaft of the fluid pressure pulse generating apparatus, and a back up seal enclosed by the housing and configured to surround a portion of the driveshaft and prevent lubricating liquid on one side of the back up seal mixing with lubricating liquid on the other side of the back up seal. The housing may comprise a first section and a second section configured to releasably mate with the first section. The back up seal assembly may further comprise a spring enclosed by the housing and positioned longitudinally adjacent and in communication with the back up seal for spring loading of the back up seal.

The back up seal assembly may further comprise a thrust bearing enclosed by the housing and configured to surround a portion of the driveshaft. Alternatively, the back up seal assembly may further comprise a first thrust bearing and a second thrust bearing enclosed by the housing and configured to surround a portion of the driveshaft. The first thrust bearing may be positioned on one side of the back up seal and the second thrust bearing may be positioned on an opposed side of the back up seal.

According to another aspect of the present disclosure, there is provided a driveshaft unit for a fluid pressure pulse generating apparatus. The driveshaft unit comprises a longitudinally extending cylindrical driveshaft and the back up seal assembly of the present disclosure surrounding a portion of the driveshaft. The driveshaft has a first end for connection with a fluid pressure pulse generator of the fluid pressure pulse generating apparatus and an opposed second end for connection with a pulse generating motor of the fluid pressure pulse generating apparatus.

The driveshaft may comprise a first sealing surface for sealing with a primary seal to prevent external fluid from entering the fluid pressure pulse generating apparatus and a second sealing surface between the first sealing surface and the second end for sealing the back up seal of the back up seal assembly. The first sealing surface, the second sealing surface or both the first and second sealing surfaces may comprise a cylinder fitted on the driveshaft. The cylinder may be configured to releasably fit on the driveshaft. The cylinder may comprise ceramic or carbide. The driveshaft may further comprise an annular shoulder against which the cylinder abuts.

According to another aspect of the present disclosure, there is provided a driveshaft for a fluid pressure pulse generating apparatus. The driveshaft comprises a longitudinally extending unitary cylindrical driveshaft and a sealing cylinder. The driveshaft has a first end for connection with a fluid pressure pulse generator of the fluid pressure pulse generating apparatus and an opposed second end for connection with a pulse generating motor of the fluid pressure pulse generating apparatus. The sealing cylinder surrounds a portion of the driveshaft for sealing with a seal to prevent external fluid from entering the fluid pressure pulse generating apparatus. The sealing cylinder is configured to releasably fit on the driveshaft. The cylinder may comprise ceramic or carbide. The driveshaft may further comprise an annular shoulder against which the sealing cylinder abuts.

According to another aspect of the present disclosure, there is provided a driveshaft for a fluid pressure pulse generating apparatus. The driveshaft comprises a longitudinally extending cylindrical driveshaft, a primary sealing cylinder and a back up sealing cylinder. The longitudinally extending cylindrical driveshaft has a first end for connection with a fluid pressure pulse generator of the fluid pressure pulse generating apparatus and an opposed second end for connection with a pulse generating motor of the fluid pressure pulse generating apparatus. The primary sealing cylinder surrounds a portion of the driveshaft for sealing with a primary seal to prevent external fluid from entering the fluid pressure pulse generating apparatus. The back up sealing cylinder surrounds a portion of the driveshaft between the primary sealing cylinder and the second end for sealing with a back up seal. At least one of the primary sealing cylinder or the back up sealing cylinder may be configured to releasably fit on the driveshaft. The primary and/or back up sealing cylinder may comprise ceramic or carbide. The driveshaft may further comprise an annular shoulder against which the primary sealing cylinder, the back up sealing cylinder, or both the primary sealing cylinder and the back up sealing cylinder abuts.

There is also provided a fluid pressure pulse generating apparatus for downhole drilling according to a first aspect of the present disclosure. The fluid pressure pulse generating apparatus of the first aspect comprises a fluid pressure pulse generator, a pulser assembly, the pressure compensation device of the present disclosure and a primary seal. The pulser assembly comprises a pulser assembly housing that houses a motor and a driveshaft extending from the motor out of the pulser assembly housing and coupling with the fluid pressure pulse generator. The pressure compensation device surrounds a portion of the driveshaft and is positioned in the pulser assembly housing so that the outer longitudinal surface of the membrane system is exposed to drilling fluid flowing external to the pulser assembly housing when the fluid pressure pulse generating apparatus is positioned downhole and the inner longitudinal surface of the membrane system is exposed to lubrication liquid contained inside the pulser assembly housing. The primary seal is enclosed by the pulser assembly housing and surrounds a portion of the driveshaft between the coupling with the pressure pulse generator and the pressure compensation device. The primary seal is configured to prevent the drilling fluid from entering the pulser assembly housing and the lubrication liquid from leaving the pulser assembly housing.

The pulser assembly housing may comprise a plurality of apertures extending therethrough. The plurality of apertures may be in fluid communication with the outer longitudinal surface of the membrane system. The fluid pressure pulse generating apparatus of the first aspect may further comprise a longitudinally extending drilling fluid chamber adjacent the outer longitudinal surface of the membrane system. The drilling fluid chamber may be in fluid communication with the plurality of apertures.

The fluid pressure pulse generating apparatus of the first aspect may further comprise a journal bearing surrounding a portion of the driveshaft between the coupling with the pressure pulse generator and the primary seal. A journal bearing housing enclosing the journal bearing may also be present on the fluid pressure pulse generating apparatus. The journal bearing housing may be configured to releasably mate with the pulser assembly housing.

The fluid pressure pulse generating apparatus of the first aspect may further comprise a primary sealing cylinder fitted on a portion of the driveshaft such that the primary seal seals against an outer sealing surface of the primary sealing cylinder and the journal bearing aligns with the outer sealing surface with a gap between the outer sealing surface and an external surface of the journal bearing. The primary sealing cylinder may be configured to releasably fit on the driveshaft. The driveshaft may comprise a first annular shoulder and the primary sealing cylinder may be positioned between the first annular shoulder and the fluid pressure pulse generator to releasably secure the primary sealing cylinder on the driveshaft.

The fluid pressure pulse generating apparatus of the first aspect may further comprise a back up seal enclosed by the pulser assembly housing and surrounding a portion of the driveshaft between the primary seal and the motor. The back up seal may be configured to prevent the lubrication liquid on a primary seal side of the back up seal from mixing with the lubrication liquid on a motor side of the back up seal. The back up seal may be positioned between the pressure compensation device and the motor. The fluid pressure pulse generating apparatus may further comprise a back up seal housing enclosing the back up seal. The back up seal housing may comprise a first section and a second section configured to releasably mate with the first section.

A back up sealing cylinder may be fitted on a portion of the driveshaft such that the back up seal seals against an outer sealing surface of the back up sealing cylinder. The back up sealing cylinder may be configured to releasably fit on the driveshaft. The back up seal housing may enclose the back up seal and the back up seal cylinder. The driveshaft may comprise a second annular shoulder and the back up sealing cylinder may be positioned between the second annular shoulder and an internal surface of the back up seal housing to releasably secure the back up sealing cylinder on the driveshaft. A retention nut may surround a portion of the driveshaft and be configured to releasably secure the first section and the second section of the back up seal housing together so as to releasably secure the back up sealing cylinder on the driveshaft.

The fluid pressure pulse generating apparatus of the first aspect may further comprise a thrust bearing surrounding a portion of the driveshaft and enclosed by the back up seal housing. A first thrust bearing surrounding a portion of the driveshaft may be provided on one side of the back up seal and a second thrust bearing surrounding a portion of the driveshaft may be provided on an opposed side of the back up seal. The first and second thrust bearings may be enclosed by the back up seal housing. A spring may be positioned longitudinally adjacent and in communication with the back up seal for spring loading the back up seal.

The lubrication liquid on the primary seal side of the back up seal may have a different composition to the lubrication liquid on the motor side of the back up seal. The lubrication liquid on the primary seal side of the back up seal may have a higher viscosity than the lubrication liquid on the motor side of the back up seal. Additionally, or alternatively, the lubrication liquid on the primary seal side of the back up seal may have a lower thermal expansion than the lubrication liquid on the motor side of the back up seal.

There is further provided a fluid pressure pulse generating apparatus for downhole drilling according to a second aspect of the present disclosure. The fluid pressure pulse generating apparatus of the second aspect comprises a fluid pressure pulse generator, a motor subassembly, a driveshaft subassembly, a primary seal and a back up seal. The motor subassembly comprises a motor subassembly housing that houses a motor and a gearbox. The driveshaft subassembly comprises a driveshaft subassembly housing that houses a driveshaft extending from the motor out of the driveshaft subassembly housing and coupling with the fluid pressure pulse generator. The primary seal surrounds a portion of the driveshaft and is configured to prevent drilling fluid from entering the driveshaft subassembly housing and lubrication liquid from leaving the driveshaft subassembly housing when the fluid pressure pulse generating apparatus is positioned downhole. The back up seal surrounds a portion of the driveshaft between the primary seal and the motor. The back up seal is configured to prevent lubrication liquid in the motor subassembly from mixing with lubrication liquid in the driveshaft subassembly.

The fluid pressure pulse generating apparatus of the second aspect may further comprise a journal bearing surrounding a portion of the driveshaft between the coupling with the pressure pulse generator and the primary seal, and optionally a journal bearing housing enclosing the journal bearing. The journal bearing housing may be configured to releasably mate with the driveshaft subassembly housing. A primary sealing cylinder may be fitted on a portion of the driveshaft such that the primary seal seals against an outer sealing surface of the primary sealing cylinder and the journal bearing aligns with the outer sealing surface with a gap between the outer sealing surface and an external surface of the journal bearing. The primary sealing cylinder may be configured to releasably fit on the driveshaft. The driveshaft may comprise a first annular shoulder and the primary sealing cylinder may be positioned between the first annular shoulder and the fluid pressure pulse generator to releasably secure the primary sealing cylinder on the driveshaft.

The fluid pressure pulse generating apparatus of the second aspect may further comprise a back up seal housing enclosing the back up seal. The back up seal housing may comprise a first section and a second section configured to releasably mate with the first section. A back up sealing cylinder may be fitted on a portion of the driveshaft such that the back up seal seals against an outer sealing surface of the back up sealing cylinder. The back up sealing cylinder may be configured to releasably fit on the driveshaft. The back up seal housing may enclose the back up seal and the back up seal cylinder. The driveshaft may comprise a second annular shoulder and the back up sealing cylinder may be positioned between the second annular shoulder and an internal surface of the back up seal housing to releasably secure the back up sealing cylinder on the driveshaft. A retention nut may surround a portion of the driveshaft and be configured to releasably secure the first section and the second section of the back up seal housing together so as to releasably secure the back up sealing cylinder on the driveshaft.

The fluid pressure pulse generating apparatus of the second aspect may further comprise a thrust bearing surrounding a portion of the driveshaft and enclosed by the back up seal housing. A first thrust bearing surrounding a portion of the driveshaft may be provided on one side of the back up seal and a second thrust bearing surrounding a portion of the driveshaft may be provided on an opposed side of the back up seal. The first and second thrust bearings may be enclosed by the back up seal housing. A spring may be positioned longitudinally adjacent and in communication with the back up seal for spring loading the back up seal.

The lubrication liquid in the driveshaft subassembly may have a different composition to the lubrication liquid in the motor subassembly. The lubrication liquid in the driveshaft subassembly may have a higher viscosity than the lubrication liquid in the motor subassembly. Additionally, or alternatively, the lubrication liquid in the driveshaft subassembly may have a lower thermal expansion than the lubrication liquid in the motor subassembly.

Furthermore, there is provided a fluid pressure pulse generating apparatus for downhole drilling according to a third aspect of the present disclosure. The fluid pressure pulse generating apparatus of the third aspect comprises a fluid pressure pulse generator, a pulser assembly, a seal and a journal bearing. The pulser assembly comprises a pulser assembly housing that houses a motor and a driveshaft extending from the motor out of the pulser assembly housing and coupling with the fluid pressure pulse generator. The seal surrounds a portion of the driveshaft and is configured to prevent drilling fluid from entering the pulser assembly housing and lubrication liquid from leaving the pulser assembly housing when the fluid pressure pulse generating apparatus is positioned downhole. The journal bearing surrounds a portion of the driveshaft between the coupling with the pressure pulse generator and the seal.

The fluid pressure pulse generating apparatus of the third aspect may further comprise a journal bearing housing enclosing the journal bearing. The journal bearing housing may be configured to releasably mate with the pulser assembly housing. A sealing cylinder may be fitted on a portion of the driveshaft such that the seal seals against an outer sealing surface of the sealing cylinder and the journal bearing aligns with the outer sealing surface with a gap between the outer sealing surface and an external surface of the journal bearing. The sealing cylinder may be configured to releasably fit on the driveshaft. The driveshaft may comprise a first annular shoulder and the sealing cylinder may be positioned between the first annular shoulder and the fluid pressure pulse generator to releasably secure the sealing cylinder on the driveshaft.

In addition, there is provided a fluid pressure pulse generating apparatus for downhole drilling according to a fourth aspect of the present disclosure. The fluid pressure pulse generating apparatus of the fourth aspect comprises a fluid pressure pulse generator, a pulser assembly and a primary seal. The pulser assembly is longitudinally adjacent the fluid pressure pulse generator with a fluid flow channel extending between adjacent surfaces thereof. The pulser assembly comprises a pulser assembly housing that houses a motor and a driveshaft extending from the motor out of the pulser assembly housing and coupling with the fluid pressure pulse generator. The primary seal surrounds a portion of the driveshaft and is configured to prevent drilling fluid from entering the pulser assembly housing and lubrication liquid from leaving the pulser assembly housing when the fluid pressure pulse generating apparatus is positioned downhole. The fluid flow channel defines at least a portion of a flow path for the drilling fluid which flows from external the pulser assembly to the primary seal when the fluid pressure pulse generating apparatus is positioned downhole. The adjacent surfaces of the pulser assembly and the fluid pressure pulse generator are configured such that the fluid flow channel comprises a tortuous flow path.

The fluid flow channel may include a plurality of changes in direction. The fluid flow channel may comprise a restricted section and an expanded section, whereby the cross sectional area of the restricted section is less than the cross sectional area of the expanded section. The expanded section may comprise an expansion chamber having an increased volume compared to the volume of the restricted section. The primary seal may be positioned uphole of the entrance to the fluid flow channel.

The pulser assembly may further comprise a journal bearing surrounding a portion of the driveshaft with a gap between an internal surface of the journal bearing and an external surface of the driveshaft. The journal bearing may be positioned on the driveshaft between the coupling with the pressure pulse generator and the primary seal. The gap may define at least a portion of the flow path for the drilling fluid. The volume of drilling fluid flowing through the gap may be restricted compared to the volume of drilling fluid in the flow path before and/or after the gap. A primary sealing cylinder may be fitted on a portion of the driveshaft such that the primary seal seals against an outer sealing surface of the primary sealing cylinder and the journal bearing aligns with the outer sealing surface such that the gap is between the outer sealing surface and the external surface of the journal bearing. The primary sealing cylinder may be configured to releasably fit on the driveshaft. The driveshaft may comprise a first annular shoulder and the primary sealing cylinder may be positioned between the first annular shoulder and the fluid pressure pulse generator to releasably secure the primary sealing cylinder on the driveshaft. The flow path for the drilling fluid may further comprises a fluid expansion chamber positioned between the journal bearing and the primary seal. The volume of drilling fluid in the fluid expansion chamber may be greater than the volume of drilling fluid in the gap. The pulser assembly may further comprise a journal bearing housing enclosing the journal bearing. The journal bearing housing may be configured to releasably mate with the pulser assembly housing.

The journal bearing housing may comprise a cylindrical section which surrounds a circular section of the fluid pressure pulse generator. The circular section of the fluid pressure pulse generator may be configured to rotate within the cylindrical section of the journal bearing housing and the fluid flow channel may extend between an internal surface of the cylindrical section and an external surface of the circular section. Alternatively, the pulser assembly housing may comprise a cylindrical section which surrounds a circular section of the fluid pressure pulse generator. The circular section of the fluid pressure pulse generator may be configured to rotate within the cylindrical section of the pulser assembly housing and the fluid flow channel may extend between an internal surface of the cylindrical section and an external surface of the circular section.

The fluid pressure pulse generating apparatus of the fourth aspect may further comprise the pressure compensation device of the present disclosure surrounding a portion of the driveshaft and positioned in the pulser assembly housing so that the outer longitudinal surface of the membrane system is exposed to the drilling fluid flowing external to the pulser assembly housing when the fluid pressure pulse generating apparatus is positioned downhole and the inner longitudinal surface of the membrane system is exposed to the lubrication liquid contained inside the pulser assembly housing. The pulser assembly housing may comprise a plurality of apertures extending therethrough. The plurality of apertures may be in fluid communication with the outer longitudinal surface of the membrane system. The fluid pressure pulse generating apparatus of the fourth aspect may further comprise a longitudinally extending drilling fluid chamber adjacent the outer longitudinal surface of the membrane system. The drilling fluid chamber may be in fluid communication with the plurality of apertures.

The fluid pressure pulse generating apparatus of the fourth aspect may further comprise a back up seal enclosed by the pulser assembly housing and surrounding a portion of the driveshaft between the primary seal and the motor. The back up seal may be configured to prevent the lubrication liquid on a primary seal side of the back up seal from mixing with the lubrication liquid on a motor side of the back up seal. A back up seal housing may enclose the back up seal. The back up seal housing may comprise a first section and a second section configured to releasably mate with the first section.

A back up sealing cylinder may be fitted on a portion of the driveshaft such that the back up seal seals against an outer sealing surface of the back up sealing cylinder. The back up sealing cylinder may be configured to releasably fit on the driveshaft. The back up seal housing may enclose the back up seal and the back up seal cylinder. The driveshaft may comprise a second annular shoulder and the back up sealing cylinder may be positioned between the second annular shoulder and an internal surface of the back up seal housing to releasably secure the back up sealing cylinder on the driveshaft. A retention nut may surround a portion of the driveshaft and be configured to releasably secure the first section and the second section of the back up seal housing together so as to releasably secure the back up sealing cylinder on the driveshaft.

The fluid pressure pulse generating apparatus of the fourth aspect may further comprise a thrust bearing surrounding a portion of the driveshaft and enclosed by the back up seal housing. A first thrust bearing surrounding a portion of the driveshaft may be provided on one side of the back up seal and a second thrust bearing surrounding a portion of the driveshaft may be provided on an opposed side of the back up seal. The first and second thrust bearings may be enclosed by the back up seal housing. A spring may be positioned longitudinally adjacent and in communication with the back up seal for spring loading the back up seal.

The lubrication liquid on the primary seal side of the back up seal may have a different composition to the lubrication liquid on the motor side of the back up seal. The lubrication liquid on the primary seal side of the back up seal may have a higher viscosity than the lubrication liquid on the motor side of the back up seal. Additionally, or alternatively, the lubrication liquid on the primary seal side of the back up seal may have a lower thermal expansion than the lubrication liquid on the motor side of the back up seal.

DETAILED DESCRIPTION

Apparatus Overview

The embodiments described herein generally relate to an apparatus or tool having a fluid pressure pulse generator. The tool is typically a MWD tool which may be used for mud pulse (MP) telemetry used in downhole drilling. The tool may alternatively be used in other methods where it is necessary to generate a fluid pressure pulse.

Figure 1:
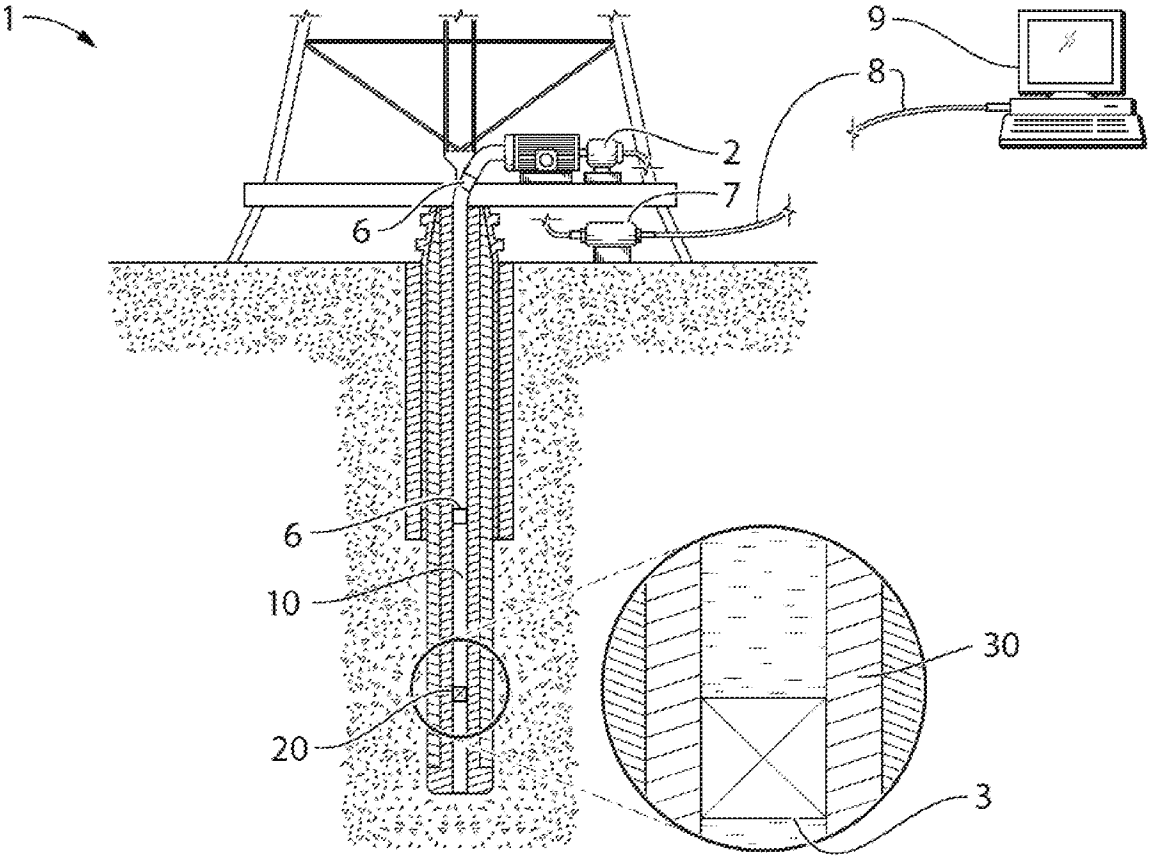
FIG. 1 is a schematic of a mud pulse (MP) telemetry method in a drill string in an oil and gas borehole using a MWD telemetry tool in accordance with embodiments of the invention.

Referring to the drawings and specifically to FIG. 1, there is shown a schematic representation of a MP telemetry method using a MWD tool according to embodiments of the invention. In downhole drilling equipment 1, drilling fluid or "mud" is pumped down a drill string by pump 2 and passes through the MWD tool 20. The MWD tool 20 includes a fluid pressure pulse generator 30 including valve 3 which generates positive fluid pressure pulses (represented schematically as pressure pulse 6). Information acquired by downhole sensors (not shown) is transmitted in specific time divisions by the pressure pulses 6 in mud column 10. More specifically, signals from sensor modules in the MWD tool 20 or in another probe (not shown) are received and processed in a data encoder in the MWD tool 20 where the data is digitally encoded as is well established in the art. This data is sent to a controller in the MWD tool 20 which then actuates the fluid pressure pulse generator 30 to generate pressure pulses 6 which contain the encoded data. The pressure pulses 6 are transmitted to the surface and detected by a surface pressure transducer 7. The measured pressure pulses are transmitted as electrical signals through transducer cable 8 to a surface computer 9 which decodes and displays the transmitted information to the drilling operator.

The characteristics of the pressure pulses 6 are defined by amplitude, duration, shape, and frequency, and these characteristics are used in various encoding systems to represent binary data. One or more signal processing techniques are used to separate undesired mud pump noise, rig noise or downward propagating noise from upward MWD signals as is known in the art. The data transmission rate is governed by Lamb's theory for acoustic waves in a drilling mud and is approximately 1.1 to 1.5 km/s. The fluid pressure pulse generator 30 must operate in an unfriendly environment with high static downhole pressures, high temperatures, high flow rates and various erosive flow types. The fluid pressure pulse generator 30 generates pulses between 100-300 psi and typically operates in a flow rate as dictated by the size of the drill pipe bore, and limited by surface pumps, drill bit total flow area (TFA), and mud motor/turbine differential requirements for drill bit rotation.

Figure 2:
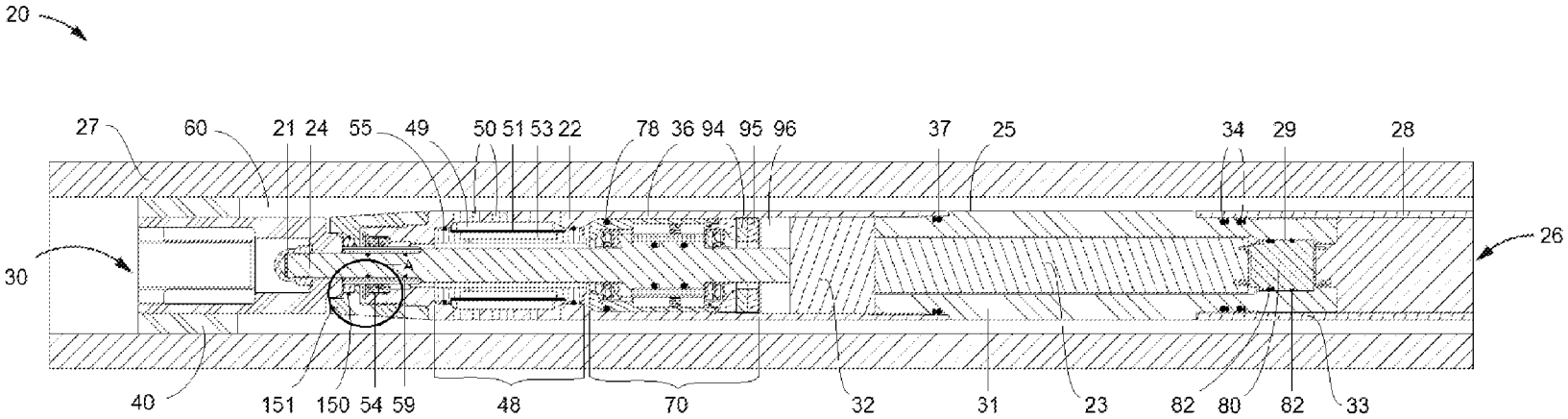
FIG. 2 is a longitudinally sectioned view of a mud pulser section of the MWD tool comprising a pressure compensation device, primary seal assembly and back up seal assembly according to embodiments of the invention.
Figure 3:
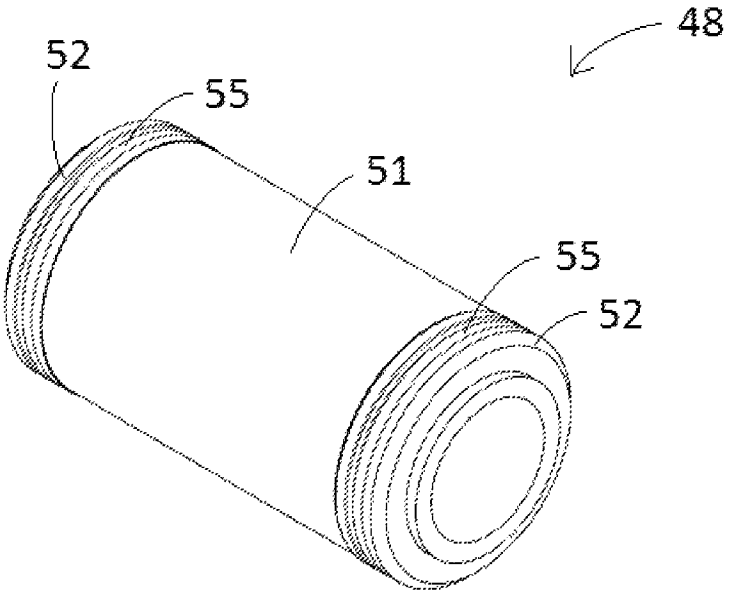
FIG. 3 is a perspective view of the pressure compensation device of the MWD tool.

Referring to FIG. 2, a mud pulser section of the MWD tool 20 is shown in more detail and generally comprises the fluid pressure pulse generator 30 which creates fluid pressure pulses and a pulser assembly 26 which takes measurements while drilling and which drives the fluid pressure pulse generator 30. The pressure pulse generator 30 and pulser assembly 26 are axially located inside a drill collar 27 with an annular gap therebetween for flow of drilling mud. The fluid pressure pulse generator 30 generally comprises a stator 40 and a rotor 60. The stator 40 is fixed to the drill collar 27 and the rotor 60 is fixed to a driveshaft 24 of the pulser assembly 26 by a rotor retention nut 21. The pulser assembly 26 includes a driveshaft subassembly 22, a motor subassembly 25 and an electronics subassembly 28.

The motor subassembly 25 includes a pressure compensated housing 31 enclosing a pulse generating motor 23 and a gearbox 32. The electronics subassembly 28 includes an electronics housing 33 which has a low pressure (approximately atmospheric) internal environment housing control electronics, and other components (not shown) required by the MWD tool 20 to receive direction and inclination information and measurements of drilling conditions and encode this information and these measurements into telemetry data for transmission by the pulse generator 30 as is known in the art. The telemetry data is converted into motor control signals and sent to the pulse generating motor 23, which then rotates the driveshaft 24 and rotor 60 in a controlled pattern to generate pressure pulses 6 representing the telemetry data, for transmission to surface.

The motor subassembly 25 and the electronics subassembly 28 are physically and electronically coupled together by a feed-through connector 29. Feed through connector 29 is a typical connector known in the art and is generally pressure rated to withstand pressure differential between the low-pressure electronics subassembly 28 (approximately atmospheric pressure) and the pressure compensated motor subassembly 25 where pressures can reach 20,000 psi. The feed through connector 29 comprises a body 80 having a generally cylindrical shape with a high pressure end facing the motor subassembly 25 and a low pressure end facing the electronics subassembly 28. Sealing O-rings 82 are provided on the external surface of the body 80 to ensure a fluid seal is established between the body 80 and the pressure compensated housing 31 of the motor subassembly 25. O-ring seals 34 are also located on an external surface of the pressure compensated housing 31 of the motor subassembly 25 to ensure a fluid seal is established between the pressure compensated housing 31 of the motor subassembly 25 and the electronics housing 33 of the electronics subassembly 28. Electrical interconnections extend axially through the length of the body 80 of the feed through connector 29; these electrical interconnections include electric motor interconnects which transmit power and control signals between components in the electronics subassembly 28 and the pulse generating motor 23 in the motor subassembly 25.

The driveshaft subassembly 22 comprises a pressure compensated housing 36 enclosing the driveshaft 24, a pressure compensation device 48, a primary seal assembly including a primary seal 54, and a back up seal assembly 70. An O-ring seal 37 located on an external surface of the pressure compensated housing 31 of motor subassembly 25 provides a fluid seal between the pressure compensated housing 31 of the motor subassembly 25 and the pressure compensated housing 36 of the driveshaft subassembly 22. The motor subassembly 25 and driveshaft subassembly 22 are filled with a lubrication liquid such as hydraulic oil or silicon oil; this lubrication liquid is fluidly separated from the mud flowing external to the pulser assembly 26. The pressure compensation device 48 equalizes the pressure of lubrication liquid inside the driveshaft subassembly 22 and motor subassembly 25 with the pressure of the drilling mud in the vicinity of the mud pulser assembly 26. Without pressure compensation, it would be difficult for the driveshaft 24 to rotate due to an excessive pressure differential between the internal lubrication liquid and the external drilling mud; the torque required to rotate the driveshaft 24 without pressure compensation would need high current draw and would lead to excessive battery consumption and increased costs.

The primary seal 54 may be a standard polymer lip seal and wiper provided near the downhole end of driveshaft 24 and enclosed by the pressure compensated housing 36 of the driveshaft subassembly 22. The primary seal 54 allows rotation of the driveshaft 24 while preventing mud from entering the pressure compensated housing 36 and lubrication liquid from leaking out of the pressure compensated housing 36, thereby maintaining the pressure of the lubrication liquid inside the pressure compensation housing 36. The back up seal assembly 70 provides a back up seal in case of failure of the primary seal 54 or the pressure compensation device 48, thereby protecting the components of the motor subassembly 25 (namely the gearbox 32 and the pulse generating motor 23) from damage caused by invading mud. The back up seal assembly 70 also separates the lubrication liquid in the driveshaft subassembly 22 from the lubrication liquid in the motor subassembly 25, thereby allowing a different lubrication liquid composition in each of the subassemblies 22, 25 as will be described in more detail below. The volume of lubrication liquid in the driveshaft subassembly 22 may be equal to, less than, or more than the volume of lubrication liquid in the motor subassembly 25 depending on the requirements of the MWD tool 20. In an alternative embodiment (not shown) the pressure compensated housing of the driveshaft subassembly 22 and the pressure compensated housing of the motor subassembly 25 may be a continuous, unitary pressure compensated housing and not two separate housings 31 and 36 as shown in FIG. 2.

There are a variety of downhole effects related to vibration, pressure differential, temperature shock and exposure to abrasive drilling mud which can cause failure of the primary seal 54 and wear of the driveshaft 24. If the primary seal 54 fails then drilling mud can enter the pressure compensated housing 36 of the driveshaft subassembly 22. If the driveshaft 24 wears down then a fluid tight seal between the driveshaft 24 and the primary seal 54 may not be possible. A primary seal assembly is therefore provided at the downhole end of the pulser assembly 26 which includes a number of features which protect the primary seal 54 and the driveshaft 24 and may prolong the life of the primary seal 54 and the driveshaft 24. These features include a primary seal cylinder 59 releasably fitted to the driveshaft 24 which provides a sealing surface for the primary seal 54, a journal bearing 150 which surrounds the primary seal cylinder 59 downhole from the primary seal 54, and a journal bearing housing 151 for housing the journal bearing 150. The downhole end of the pulser assembly 26 is also configured to provide a tortuous flow path for the drilling mud before the drilling mud reaches the primary seal 54 in order to reduce the velocity of flow of drilling mud that contacts the seal, which may beneficially reduce wear of the primary seal 54.

The pressure compensation device 48; the driveshaft 24 with the primary seal cylinder 59 and the back up seal assembly 70; the journal bearing 150 and journal bearing housing 151; and the tortuous mud flow path will now each be described in more detail.

Pressure Compensation Device

Referring now to FIGS. 2, 3, 4A and 4B, the pressure compensation device 48 is a tubular device that extends around a portion of the driveshaft 24 and is enclosed by the pressure compensated housing 36 of the driveshaft subassembly 22. The pressure compensation device 48 comprises a generally cylindrical flexible membrane system 51 and a membrane support 52 for supporting the membrane system 51. The support 52 comprises a generally cylindrical structure with a central bore that allows the driveshaft 24 to extend therethrough. The support 52 has two end sections with an outer diameter that abuts against the inside surface of the pressure compensated housing 36, and O-ring seals 55 located in each end section to provide a fluid seal between the housing 36 and the end sections. The end sections each also have a membrane mount for mounting respective ends of the membrane system 51. Extending between the end sections of the support 52 and internal to the membrane system 51 are a plurality of longitudinally extending lubrication liquid compensation chambers 53 that are filled with lubrication liquid contained inside the driveshaft subassembly 22 when the pressure compensation device 48 is positioned on the driveshaft 24.

As shown in FIG. 2, the pressure compensated housing 36 of the driveshaft subassembly 22 comprises a plurality of ports 50 which extend radially through the housing wall and a mud compensation chamber 49 which extends longitudinally between the housing 36 and the membrane system 51 of the pressure compensation device 48. The mud compensation chamber 49 is longitudinally offset and in fluid communication with the ports 50 so that drilling mud external to the pressure compensated housing 36 flows through ports 50 into the mud compensation chamber 49 along a flow path that changes in direction, restricts and expands before the mud contacts the membrane system 51. The mud contacting the membrane system 51 is therefore at a reduced flow velocity compared to the mud flowing external to the pressure compensated housing 36 which may beneficially reduce wear of the membrane system 51. The membrane system 51 provides a fluid barrier between the mud in the mud compensation chamber 49 and the lubrication liquid in the lubrication liquid compensation chambers 53.

Figures 4A, 4B:
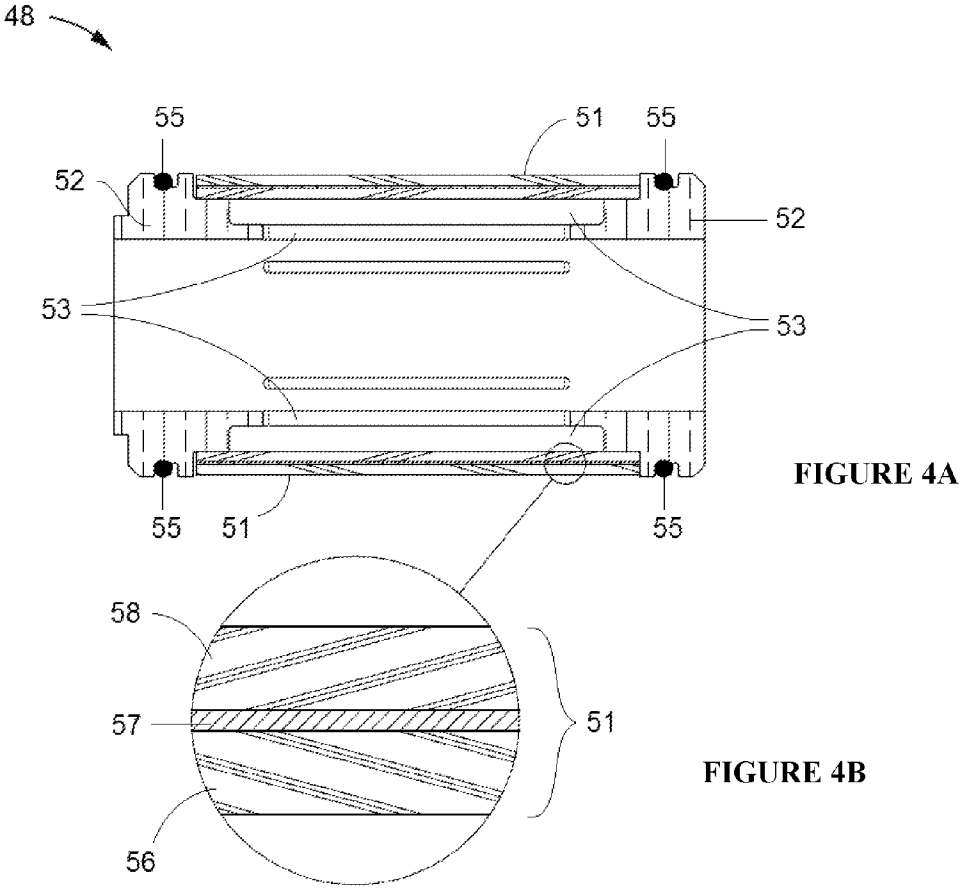
FIG. 4A is a longitudinally sectioned view of the pressure compensation device of FIG. 3 comprising a membrane system and FIG. 4B is a close up sectional view of the membrane system.

As shown in FIG. 4B, the membrane system 51 comprises an outer membrane sleeve 56, an inner membrane sleeve 58 and a thermally resistive layer 57 sandwiched between the outer membrane sleeve 56 and the inner membrane sleeve 58. The outer and inner membrane sleeves 56, 58 may be made of a flexible polymer, for example, but not limited to, rubber or some other flexible polymer such as fluorocarbons (for example Viton™) that is able to flex to compensate for pressure changes in the drilling mud and allow the pressure of the lubrication liquid inside the driveshaft subassembly 22 to substantially equalize with the pressure of the external drilling mud. Without pressure compensation, it would be very difficult for the driveshaft 24 to rotate due to excessive pressure differential between the internal lubrication liquid and the external drilling mud. The inner membrane sleeve 58 may be made of the same polymer material as the outer membrane sleeve 56 or a different polymer material. For example, the membrane material of the outer membrane sleeve 56 may be selected to withstand the high temperatures and harsh drilling environment as well as the abrasive properties of the external drilling mud which is in contact with the outer membrane sleeve 56, whereas the membrane material of the inner membrane sleeve 58, while still needing to withstand the high temperatures and harsh drilling environment, may be selected for its sealing and bonding properties as well as for its compatibility with the lubrication liquid that is internal to the driveshaft subassembly 22 and its pressure compensation properties. The outer membrane sleeve 56 is typically subjected to the harsh conditions of the external drilling environment and protects the thermally resistive layer 57 from these conditions. The thermally resistive layer 57 can therefore be made of a thermally resistive material such as glass, fibreglass, or any other flexible low thermal conductivity material, which may otherwise be prone to degradation if exposed to the external drilling mud. The thermally resistive layer 57 protects the inner membrane sleeve 58 from thermal shock by providing a slow thermal gradient transfer to the inner membrane sleeve 58. Thermal shock can lead to cracking and degradation of the membrane material, therefore reduction of thermal shock potentially increases the life of the inner membrane sleeve 58. The inner membrane sleeve 58 is bonded in a sealing manner to the membrane mounts of the membrane support 52 or fixed with clamps, cables or any other means which seals the membrane to the membrane mounts as would be apparent to a person of skill in the art. The thermally resistive layer 57 may be bonded to the outer membrane sleeve 56 or to the inner membrane sleeve 58 or may not be bonded or fixed to either of the membrane sleeves 56, 58 and may instead be free floating between the membrane sleeves 56, 58. In one embodiment, the inner and outer membrane sleeves 58, 56, (and optionally the thermally resistive layer 57) are each bonded or clamped to the membrane mounts of the membrane support 52 in a sealing manner.

In one embodiment, the inner membrane sleeve 58 functions as a sealing membrane preventing drilling mud from entering and lubrication liquid from exiting the driveshaft subassembly 22 and the outer membrane sleeve 56 functions as a protective membrane to protect the thermally resistive layer 57 and/or the inner membrane sleeve 58 from the harsh external drilling environment. In alternative embodiments, the outer membrane sleeve 56 and the inner membrane both function as a sealing membrane so as to provide a primary sealing element and a secondary sealing element to the pressure compensation device 48, with the outer membrane sleeve 56 also functioning as a protective membrane.

Provision of the inner membrane sleeve 58 beneficially provides a fail safe or back up sealing membrane if there is failure of the outer membrane sleeve 56. The thermally resistive layer 57 generally provides the added benefit of protecting the inner membrane sleeve 58 from thermal shock, thereby typically extending the life of the inner membrane sleeve 58 and providing a cost effective thermally resistive pressure compensation system compared to known thermally resistive systems such as bellows and metal membrane systems. By increasing the life of the inner membrane sleeve 58, the life of the pressure compensation device 48 is generally prolonged and the time between services of the device 48 can be extended, which may beneficially reduce drilling operation costs. If there is failure of the membrane system 51, the system 51 can be easily, quickly and cheaply replaced compared to other known pressure compensation systems such as bellows. Provision of two sealing membranes 56, 58 may also increase the reliability of the pressure compensation device 48.

In alternative embodiments the membrane system 51 may comprise only the inner and outer membrane sleeves without the thermally resistive layer. In further alternative embodiments, the membrane system 51 may include additional membrane sleeves, and/or thermally resistive layers which may provide extra protection against membrane failure. The number of membranes and/or thermally resistive layers may be selected based on performance and space requirements as well as other properties of the pressure compensation device such as sealing and pressure compensation.

Driveshaft with Primary Seal Cylinder, Back Up Seal Cylinder and Back Up Seal Assembly Referring now to FIGS. 2, 5, 6 and 7, there is shown the driveshaft 24 of the driveshaft subassembly 22 with the primary seal cylinder 59 near the downhole end of the driveshaft 24 and a back up seal cylinder 79 near the uphole end of the driveshaft 24. The back up seal assembly 70 is positioned around the back up seal cylinder 79.

The driveshaft 24 is a generally cylindrical unitary body that may comprise a material with a low modulus of rigidity which may have a high fatigue resistance and/or high yield strength, such as titanium, for absorption of shock energy. Provision of a unitary driveshaft body typically reduces the amount of backlash and may result in a zero backlash driveline. The primary seal cylinder 59 and the back up seal cylinder 79 may be made of ceramic material, such as zirconia, or carbide and provide a surface against which the primary seal 54 and a back up seal 76 can seal upon respectively. The primary seal cylinder 59 and the back up seal cylinder 79 are releasably fixed or fitted to the driveshaft 24. The primary seal cylinder 59 is fitted by sliding the primary seal cylinder 59 onto the downhole end of the driveshaft 24 until the uphole end of the primary seal cylinder 59 abuts a shoulder 93 of the driveshaft 24, whereas the back up seal cylinder 79 is fitted by sliding the back up seal cylinder 79 onto the uphole end of the driveshaft 24 until the downhole end of the back up seal cylinder 79 abuts a shoulder 91 of the driveshaft 24. A pair of O-ring seals 61 are positioned between the internal surface of the primary seal cylinder 59 and the external surface of the driveshaft 24 and a pair of O-rings seals 62 are positioned between the internal surface of the back up seal cylinder 79 and the external surface of the driveshaft 24; these O-ring seals provide a fluid seal and may also create a pressure lock to releasably lock the primary seal cylinder 59 and the back up seal cylinder 79 on the driveshaft. In alternative embodiments some other releasable locking mechanism may be provided to releasably lock the primary seal cylinder 59 and the back up seal cylinder 79 onto the driveshaft 24 and more or less than two O-ring seals may be used.

Primary seal cylinder 59 and back up seal cylinder 79 generally protect the driveshaft 24 from wear. After time, the primary seal cylinder 59 may become scored or worn from friction caused by rotation of the primary seal cylinder 59 against the journal bearing 150 and the primary seal 54 in the presence of abrasive drilling mud. The back up seal cylinder 79 may also become worn over time from rotation of the back up seal cylinder 79 against the back up seal 76. When the primary seal cylinder 59 or the back up seal cylinder 79 become worn, they can easily be removed from the driveshaft 24 and replaced instead of having to replace the whole driveshaft 24. In an alternative embodiment, the primary seal cylinder 59 and/or back up seal cylinder 79 may be permanently fixed to or incorporated on the driveshaft 24. In a further alternative embodiment, the primary seal cylinder 59 and/or back up seal cylinder 79 need not be present, and the driveshaft 24 may instead present a sealing surface against which the primary seal 54 and/or back up seal 76 can seal upon. In a further alternative embodiment, the primary seal cylinder 59 may only align with the primary seal 54 and not with the journal bearing 150 or vice versa.

During assembly, the primary seal cylinder 59 may be held on the driveshaft 24 by a recessed snap ring (not shown) which is positioned on the downhole side of the primary seal cylinder 59. The snap ring typically prevents the primary seal cylinder 59 from popping off the driveshaft during overpressurization of the lubrication liquid in the driveshaft subassembly 22 which is discussed in detail below. When the rotor 60 is installed on the driveshaft, the uphole surface of the rotor abuts the downhole end of the primary seal cylinder 59 and the rotor 60 is keyed to the driveshaft 24 by a key (not shown) and compressed against the primary seal cylinder 59 by the rotor retention nut 21. As shown in FIG. 2, the primary seal cylinder 59 and the rotor 60 therefore enclose the portion of the driveshaft that would otherwise be exposed to abrasive drilling mud, thereby protecting the driveshaft 24 from wear. The primary seal cylinder 59 and the rotor 60 are both high wear resistive items that can be replaced when they become worn.

Back up seal assembly 70 comprises a generally cylindrical back up seal housing 71 surrounding the driveshaft 24 with an end cap 72 mated with the uphole end of the housing 71. A retention O-ring 77 positioned between the internal surface of the housing 71 and the external surface of the end cap 72 holds the end cap 72 in place without the need for an interference fit, however other means of mating the end cap 72 with the housing 71 could be used as would be apparent to a person skilled in the art. The downhole end of the back up seal housing 71 has a tapered external surface to correspond to a tapered shoulder on the internal surface of the pressure compensated housing 36 of the driveshaft subassembly 22 to allow for concentric mating of the back up seal housing 71 in the pressure compensated housing 36 as shown in FIG. 2. An O-ring seal 78 is provided on the external surface of the back up seal housing 71 to ensure a fluid seal is established between the back up seal housing 71 and the pressure compensated housing 36 of the driveshaft subassembly 22. Provision of the back up seal assembly 70 on the driveshaft 24 rather than having a separate piston type back up seal assembly beneficially reduces the length of the MWD tool 20 and eliminates the need for driveline key/shift connections which can lead to backlash.

The back up seal housing 71, mated end cap 72 and the back up seal cylinder 79 form a back up seal chamber 92 filled with lubrication liquid; which chamber 92 encloses the back up seal 76 and a spring 75 positioned longitudinally adjacent and uphole to the seal 76. A pair of ring shaped thrust bearings 74 surround the driveshaft 24; one of the thrust bearings 74 is positioned near the uphole end of the back up seal assembly 70 and the other thrust bearing 74 is positioned near the downhole end of the back up seal assembly 70. The uphole thrust bearing 74 is enclosed by the end cap 72, and the inner surface of the uphole thrust bearing abuts a shoulder 90 of the driveshaft 24 as well as the uphole end of the back up seal cylinder 79. The downhole thrust bearing 74 is enclosed by the back up seal housing 71, and the inner surface of the downhole thrust bearing 74 abuts driveshaft shoulder 91. There is a small gap between the internal surface of the thrust bearings 74 and the external surface of the driveshaft 24; which gap is filled with lubrication liquid. The thrust bearings 74 allow rotation of the driveshaft 24 within the back up seal assembly 70 whilst managing axial loads created by generation of fluid pressure pulses by the pressure pulse generator 30 which can cause axial loading of the rotor 60 and driveshaft 24. Axial loads can cause the back up seal 76 to become worn; by reducing the axial loads, the thrust bearings 74 may extend the life of the back up seal 76. Exemplary thrust bearings 74 that may be utilized in the back up seal assembly 70 include single direction thrust ball bearings from SKF™.

The back up seal 76 may be a polymer seal which surrounds the back up seal cylinder 79. The back up seal 76 can move axially within the chamber 92 to transfer pressure compensation between the driveshaft subassembly 22 and the motor subassembly 25. Axial movement of the back up seal 76 also allows the back up seal 76 to handle thermal expansion and pressure differential changes of the lubrication liquid. The back up seal 76 is spring loaded at its uphole end by spring 75, which provides a positive pressure to the lubrication liquid in the driveshaft subassembly 22, thereby creating an overpressure in the lubrication liquid at the uphole side of the primary seal 54. Overpressurizing the lubrication liquid in the driveshaft subassembly 22 may cause the membrane system 51 of the pressure compensation device 48 to bulge out into the mud compensation chamber 49. This bulging of the membrane system 51 may be induced by spring loading the back up seal 76 during filling with lubrication liquid so as to create an overpressure of the lubrication liquid in driveshaft subassembly 22. Overpressure of the lubrication liquid contained in the driveshaft subassembly 22 may also be generated in other ways; for example: filling the driveshaft subassembly 22 with a cold lubrication liquid (such as oil) which expands as it goes downhole; leaving a threaded joint of the driveshaft subassembly 22 untorqued, then filling the driveshaft subassembly 22 with lubrication liquid and torquing the threaded joint to decrease the internal volume of the driveshaft subassembly 22 and bulge out the membrane system 51 of the pressure compensation device 48; or applying a vacuum to the membrane system 51 of the pressure compensation device 48 to expand the internal volume of the driveshaft subassembly, then filling the driveshaft subassembly with lubrication liquid. It may be operationally advantageous to over-pressurise the lubrication liquid internal to the driveshaft subassembly so that there is a small amount of leakage of lubrication liquid through the primary seal 54 rather than having abrasive drilling mud enter the primary seal 54 which generally causes the primary seal 54 to wear more quickly. The life of the primary seal 54 may therefore be extended. Furthermore, the positive overpressure of lubrication liquid in the driveshaft subassembly 22 may beneficially result in push back from the pressurized lubrication liquid in the motor subassembly 25 if the driveshaft subassembly 22 is infiltrated with drilling mud. If the situation arises where all, or most of the lubrication liquid leaks or is forced out of the driveshaft subassembly 22, the motor subassembly 25 may be in a vacuum as a result of spring extension. This can act as an indicator of failure of the primary seal 54 or of the membrane system 51 of the pressure compensation device 48. Detection of decreasing pressure to vacuum like conditions in the motor subassembly 25 by a pressure transducer or the like, could be used to predict life of the primary seal 54 or the membrane system 51.

Figure 5:
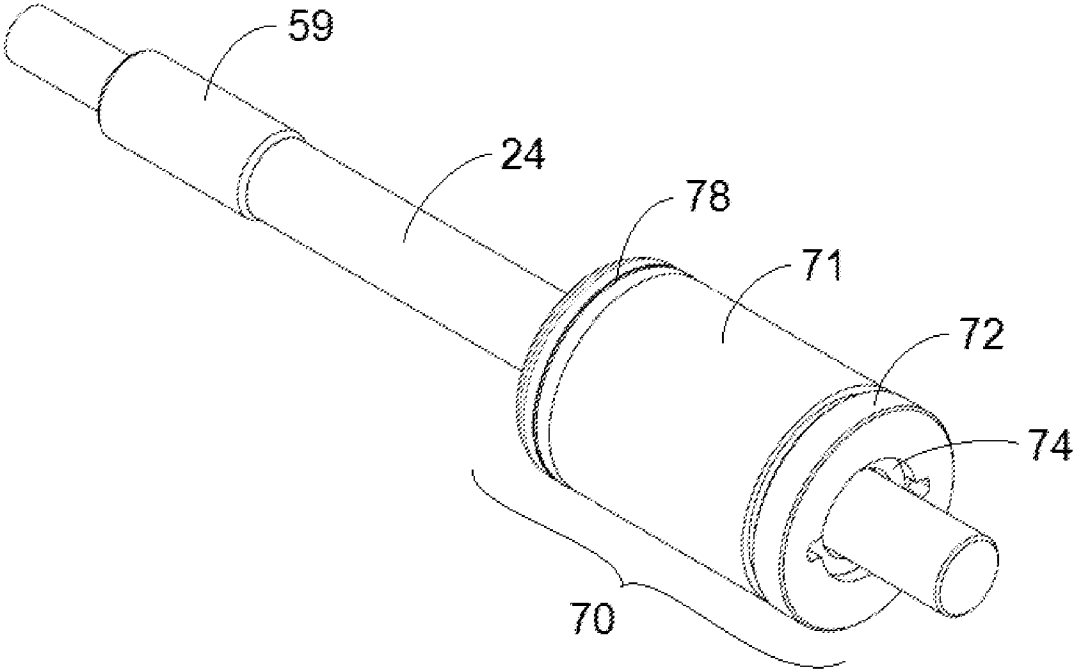
FIG. 5 is a perspective view of a driveshaft unit with a primary seal cylinder, a back up seal cylinder and the back up seal assembly of the MWD tool.
Figure 6:
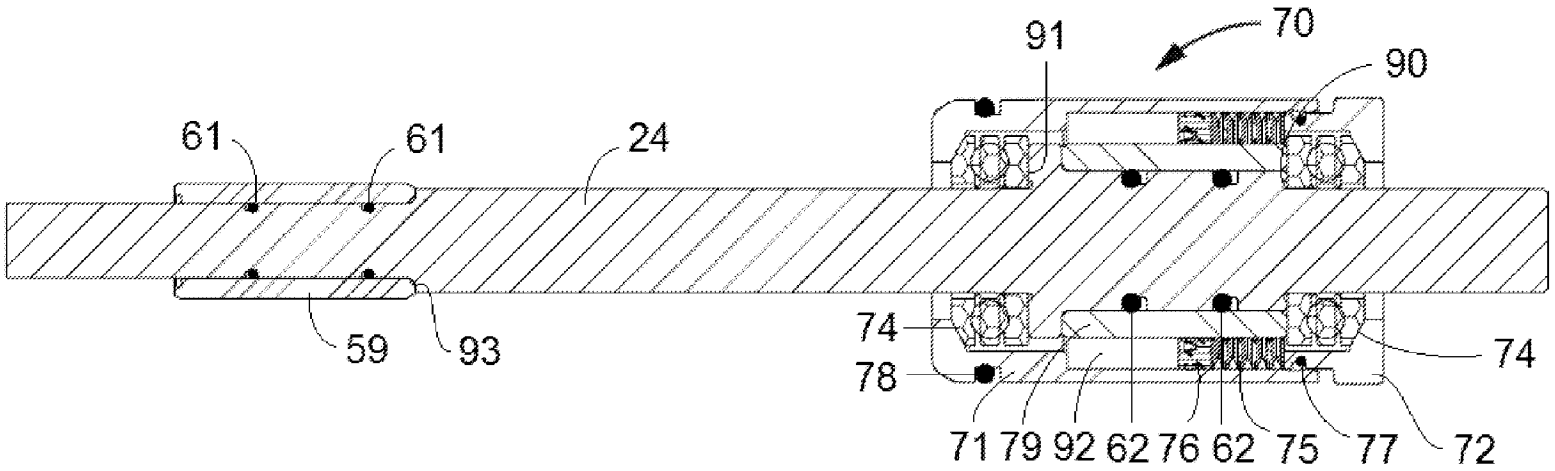
FIG. 6 is a longitudinally sectioned view of the driveshaft unit of FIG. 5.

The back up seal 76 provides a fluid barrier to prevent lubrication liquid from passing between the driveshaft subassembly 22 and the motor subassembly 25, while still allowing rotation of the driveshaft 24. This protects against drilling mud entering the motor subassembly 25 if there is failure of the primary seal 54 or the membrane system 51 of the pressure compensation device 48. The typically expensive components of the motor subassembly 25, namely the gearbox 32 and the pulse generating motor 23, are therefore beneficially protected from damage caused by invading mud. If mud does enter the driveshaft subassembly 22 due to failure of the primary seal 54 or the membrane system 51, the thrust bearings 74 and other bearings in the driveshaft subassembly 22 can operate in the harsh environment presented by the presence of drilling mud for a period of time. The thrust bearings 74 may also provide some protection to the back up seal 76 by inhibiting the amount of invading mud that reaches the back up seal 76 if there is failure of the primary seal 54 or membrane system 51 of the pressure compensation device 48. The MWD tool 20 may therefore still be able to operate for a period of time after mud has entered the driveshaft subassembly 22 until a scheduled trip out of hole for the MWD tool 20, which may reduce operation costs by reducing the number of trip outs required. The components of the driveshaft subassembly 22 can be serviced or replaced at a reduced cost compared to replacement of the components of the motor subassembly 25. For example, a driveshaft unit comprising the driveshaft 24 and back up seal assembly 70 as shown in FIGS. 5 and 6 may be sold as a separate stand alone replacement unit which can quickly and easily be fitted in the MWD tool 20 to replace a damaged unit as discussed below in more detail. The life of the MWD tool 20 may therefore be extended.

Separation of fluid between the driveshaft subassembly 22 and the motor subassembly 25 also allows a different composition of lubrication liquid in each subassembly 22, 25. For example, the lubrication liquid in the driveshaft subassembly 22 may be lubricating oil with a higher viscosity than lubricating oil in the motor subassembly 25. A higher viscosity oil in the driveshaft subassembly 22 may be chosen to aid in preventing oil leakage at the primary seal 54, whereas the lower viscosity oil in the motor subassembly 25 may be chosen to optimize motor operating conditions which may reduce operation costs and prolong the life of the motor 23 and gearbox 32. The lubrication liquid in each of the two subassemblies 22, 25 can be chosen to thermally match each other or to be complimentary. For example, the lubrication liquid in the driveshaft subassembly 22 may be less thermally expansive than the lubrication liquid in the motor subassembly 25, so as to present less thermal expansion pressure on the membrane system 51 of the pressure compensation device 48. A different optimal lubrication liquid for each of the driveshaft subassembly 22 and motor subassembly 25 can therefore be chosen rather than requiring a lubrication liquid which is a compromise for operation of both subassemblies 22, 25. During servicing, lubrication liquid can be drained from either the driveshaft subassembly 22 or the motor subassembly 25 or both, and replaced with new lubrication liquid depending on servicing requirements. This may provide faster servicing of the MWD tool 20 if only one of the subassemblies 22, 25 needs to be drained at the time. In addition, as the lubrication liquid composition can be different in each of the driveshaft subassembly 22 and the motor subassembly 25, the life of the lubrication liquid in each subassembly 22, 25 may be different, which can be factored into the servicing requirements as the subassemblies 22, 25 can be independently drained and serviced. Furthermore, provision of different compositions of lubrication liquid in the driveshaft subassembly 22 and the motor subassembly 25, may provide an indicator of life of the back up seal 76. More specifically, if there is a change in composition of the lubrication liquid in the motor subassembly 25 or in the driveshaft subassembly 22, this may indicate that the back up seal 76 has been compromised and needs to be replaced, as lubricating liquid is being transferred from the driveshaft subassembly 22 to the motor subassembly 25 or vice versa.

The back up seal assembly 70 may be manufactured and sold as a stand alone item that can be easily fitted within the pulser assembly 26 of the MWD tool 20 or any other tool that generates fluid pressure pulses. Inside the back up seal assembly 70, the lubrication liquid on one side of the back up seal 76 may be different from the lubrication liquid on the other side of the back up seal 76 beneficially providing a compact, self contained, dual lubrication liquid assembly. The assembly 70 can be readily removed and serviced or replaced if any of the components, such as the back up seal 76, become worn or damaged. Parts within the back up seal housing 71 may be accessed by removal of the end cap 72 for easy serviceability. Before fitting the seal assembly 70 onto the driveshaft 24, the back up seal cylinder 79 may be fitted to the driveshaft 24 by sliding the cylinder 79 over the uphole end of the driveshaft 24 and moving the cylinder towards the downhole end of the driveshaft 24 until the downhole end of the cylinder 79 abuts the uphole side of the driveshaft shoulder 91. The seal assembly 70 is then fitted onto the driveshaft 24 by sliding the uphole end of the housing 71 over the downhole end of the driveshaft 24 and moving the housing 71 towards the uphole end of the driveshaft 24 until the downhole thrust bearing 74 abuts the downhole side of the driveshaft shoulder 91. The end cap 72 including the uphole thrust bearing 74 is mated with the uphole end of the housing 71 to complete the back up seal assembly 70. The primary seal cylinder 59 is then slotted over the downhole end of the driveshaft 24 and moved towards the uphole end of the driveshaft 24 until the uphole end of the primary seal cylinder 59 abuts the driveshaft shoulder 93. In alternative embodiments, the back up seal assembly housing need not comprise an end cap 72 and seal housing 71 as described with reference to FIGS. 5 and 6, and may instead comprise sectional housing parts which releasably fit together. In a further alternative embodiment, the seal assembly housing may be a unitary housing and not a multi-sectioned housing. In an alternative embodiment, the primary seal cylinder 59 may abut against the downhole side of a driveshaft annular shoulder and the back up seal cylinder 79 may abut against the uphole side of the same driveshaft annular shoulder.

A driveshaft unit comprising the driveshaft 24 with fitted primary seal cylinder 59 and back up seal cylinder 79 together with the fitted back up seal assembly 70 may be manufactured and sold as a stand alone item. Alternatively, the primary seal cylinder 59, back up seal cylinder 79 and seal assembly 70 may be manufactured and sold as separate items which can be fitted to a driveshaft 24 of an existing tool. In alternative embodiments one or both of the primary seal cylinder 59 and back up seal cylinder 79 need not be present on the driveshaft 24, and the primary seal 54 and back up seal 76 may seal directly onto the driveshaft surface.

In the assembled MWD tool shown in FIG. 2, the back up seal assembly 70 is positioned uphole of the pressure compensation device 48 and downhole of the gearbox 32 and pulse generating motor 23 of the motor subassembly 25 to protect the motor 23 and gearbox 32 from drilling mud in the event of failure of the primary seal 54 and/or membrane system 51 of the pressure compensation device 48. In alternative embodiments (not shown) the back up seal assembly 70 may be positioned on the downhole side of the pressure compensation device or at any position on the driveshaft between the primary seal 54 and the motor subassembly 25. A cylindrical bearing preload nut 94 is positioned at the uphole end of the back up seal assembly 70 next to the end cap 72 and a cylindrical jam nut 95 is positioned on the uphole side of the bearing preload nut 94. The bearing preload nut 94 applies a predetermined load to the thrust bearings 74 of the back up seal assembly 70 and jam nut 95 typically prevents the bearing preload nut 94 from backing off. A chamber 96 on the uphole side of the jam nut 95 is filled with lubrication liquid, and the lubrication liquid in chamber 96 is fluidly sealed from the lubrication liquid in chamber 92 of the back up seal assembly 70 by the back up seal 76. The lubrication liquid in each of chambers 96 and 92 can therefore be of different composition as discussed above in detail. The non-integral primary seal cylinder 59 and back up seal cylinder 79 are secured on the driveshaft by positioning the primary seal cylinder 59 and back up seal cylinder 79 between the annular shoulders 93, 91 of the driveshaft and non-integral components of the MWD tool. More specifically, primary seal cylinder 59 abuts annular driveshaft shoulder 93 and is secured in position on the driveshaft 24 by the rotor 60 which is secured to the driveshaft 24 by the rotor retention nut 21, such that the driveshaft 24 is protected from wear/erosion. The rotor 60 can simply be removed in order to service the primary seal cylinder 59 when it becomes worn. Back up seal cylinder 79 abuts annular driveshaft shoulder 91 and is secured in position on the driveshaft 24 by the uphole thrust bearing 74 of the end cap 72 which is secured in position on the driveshaft by bearing preload nut 94. Bearing preload nut 94 therefore acts as a retention nut to secure the back up seal assembly 70 and back up seal cylinder 79 in position on the driveshaft 24. Bearing preload nut 94 and end cap 72 can simply be removed in order to replace the back up seal cylinder 79 when it becomes worn. Securing the non-integral primary seal cylinder 59 and back up seal cylinder 79 with non-integral components of the tool therefore allows for ease of installment and replacement of the primary seal cylinder 59 and back up seal cylinder 79 which can beneficially reduce service and operation costs.

In alternative embodiments, the back up seal housing and other components of the back up seal assembly, such as the thrust bearings 74 and spring 75, need not be present and the back up seal 76 may simply be enclosed in the pressure compensated housing 36 of the driveshaft subassembly 22. The innovative aspects of the invention apply equally in embodiments such as these.

Primary Seal Assembly Including Journal Bearing and Journal Bearing Housing

Figure 7:
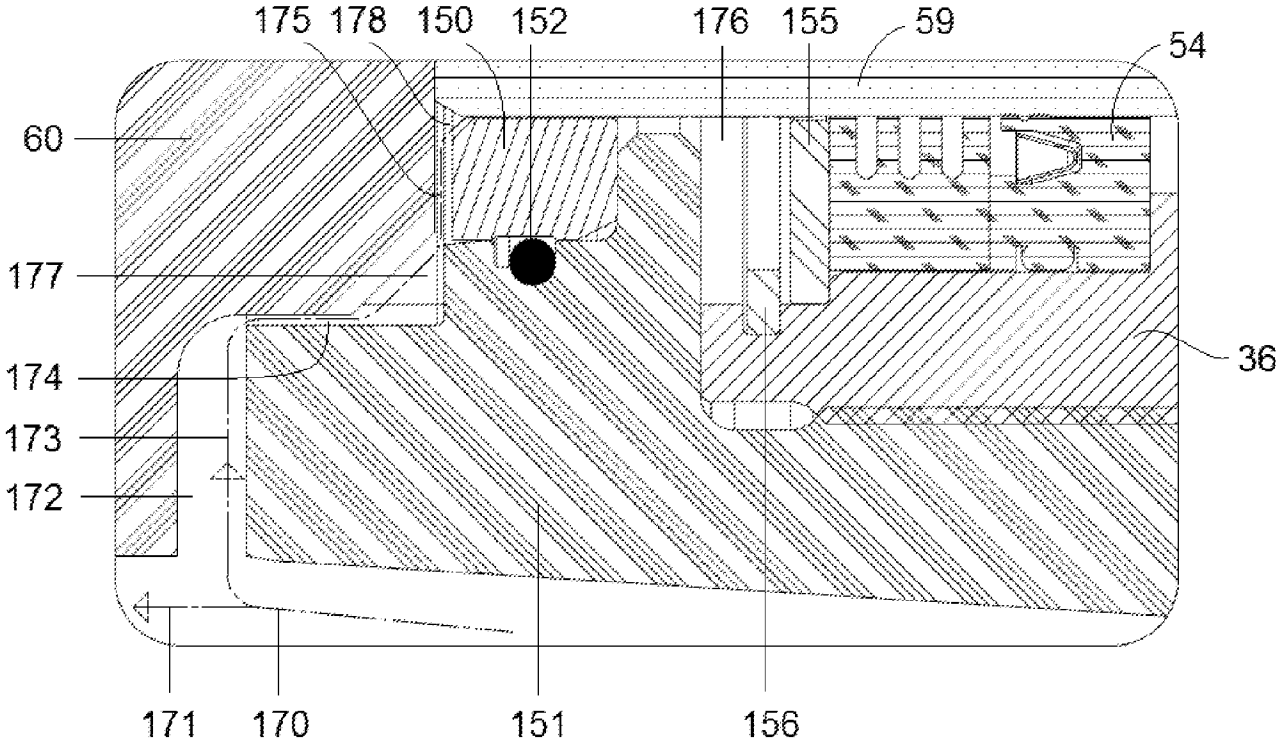
FIG. 7 is a close up longitudinal sectioned view of A in FIG. 2 showing the primary seal assembly of the MWD tool.

Referring now to FIGS. 2 and 7, the primary seal assembly includes the primary seal 54 and the journal bearing 150 positioned downhole of the primary seal 54 in the journal bearing housing 151; the journal bearing housing 151 being fitted to the downhole end of the pressure compensation housing 36 of the driveshaft subassembly 22. The primary seal 54 is held in place by a seal retention washer 155 positioned downhole of the seal, which typically protects the primary seal 54 from impinging flow of drilling mud and creates a large surface area to hold the seal in place. A washer retention ring 156 is positioned downhole of the washer 155 to hold the washer 155 in place. The generally ring shaped journal bearing 150 surrounds the primary seal cylinder 59 with a small gap therebetween; which gap is filled with drilling mud for lubrication of the journal bearing 150. The journal bearing 150 may be made of a material selected for its low frictional properties, for example metal (such as oil or graphite impregnated metal or virgin metal), ceramic, carbide or plastic. A retention O-ring 152 is fitted between the external surface of the journal bearing 150 and the journal bearing housing 151 to hold the journal bearing 150 in place within the housing 151 without requiring an interference fit. The journal bearing 150 laterally supports the driveshaft 24 thereby helping to hold the driveshaft 24 linear within the pulser assembly 26. This may beneficially increase seal life by reducing the radial (side to side) loads being transferred to the primary seal 54 which typically damage the seal 54. The journal bearing also provides a restriction point for flow of drilling mud before the drilling mud reaches the primary seal 54, which may increase the seal life by reducing the velocity of flow of drilling mud that contacts the primary seal 54, as described below in more detail. By increasing seal life, the seal 54 typically needs to be replaced less frequently, thereby reducing operation and servicing costs and increasing reliability. The journal bearing 150 is in contact with abrasive drilling mud and is therefore prone to wear after a period of use. When the journal bearing 150 becomes worn, the journal bearing housing 151 can be easily removed from the pressure compensation housing 36 and the journal bearing 150 can be replaced.

The journal bearing housing 151 has a generally truncated cone shaped external surface with an external diameter of the downhole end of the housing being less that the external diameter of the uphole end of the housing. An internal surface of the housing 151 mates with an external surface of the pressure compensated housing 36 of the driveshaft subassembly 22, so that the journal bearing housing 151 can releasably fit onto the downhole end of the pressure compensated housing 36 and is positioned longitudinally adjacent the rotor 60 of the pressure pulse generator 30 in the assembled MWD tool 20. The downhole end of the journal bearing housing 151 includes a recess which receives an extended circular section of the uphole end of the rotor 60. An outer cylindrical section of the journal bearing housing 151 therefore surrounds the extended circular section of the rotor 60 and the internal surface of the outer section of the journal bearing housing aligns with the external surface of the extended portion of the rotor with a narrow channel 174 therebetween. The channel 174 is filled with drilling mud and the outer section of the journal bearing housing 151 therefore functions as an additional journal bearing to laterally support the rotating rotor 60 and thus the driveshaft 24 and provide a back up journal bearing if the journal bearing 150 becomes worn. Channel 174 provides a restriction point for flow of drilling mud before the mud reaches the primary seal 54 as described in more detail below. The journal bearing housing 151 is in contact with abrasive drilling mud and may therefore be prone to wear after a period of use, in particular the portion of the journal bearing housing that forms channel 174 and acts as an additional journal bearing. When the journal bearing housing 151 becomes worn it can be easily removed from the pressure compensation housing 36 and serviced or replaced.

The primary seal cylinder 59, journal bearing 150 and journal bearing housing 151 which are high wear items are therefore designed for easy removal and servicing to increase the serviceability of the MWD tool 20 as the high wear items are replaceable components.

In an alternative embodiment, the journal bearing housing 151 need not be present and the journal bearing 150 may be enclosed by the pressure compensated housing 36 of the driveshaft subassembly 22. In this embodiment, the pressure compensated housing 36 may be configured to provide an outer cylindrical section which surrounds the extending circular section of the rotor 60 to function as an additional journal bearing and provide a restriction channel for flow of drilling mud. The innovative aspects of the invention apply equally in embodiments such as these.

Tortuous Mud Flow Path

One or more of the journal bearing housing 151, the rotor 60, the journal bearing 150 and other parts of the primary seal assembly, such as the seal retention washer 155, may be configured to provide a tortuous flow path for drilling mud which flows between the downhole end of the pulser assembly 26 and the uphole end of the rotor 60 and along the external surface of the driveshaft, or primary seal cylinder 59 if present, to the primary seal 54. In the embodiment shown in FIGS. 2 and 7, the drilling mud flows from uphole to downhole external to the pulser assembly 26 as represented by line 170. Most of the mud is non-impinging and flows past the external surface of the rotor 60 as represented by arrow 171. Some of the mud however diverts into contraction channel 172 between the downhole end of the journal bearing housing 151 and the uphole end of rotor 60, as represented by arrow 173; contraction channel 172 provides a first restriction point for the flow path. The flow path then diverts again and is reduced in size through contraction channel 174, which provides a second restriction. The flow path diverts a third time into an expansion chamber 177 and a fourth time into contraction channel 175 between the journal bearing 150 and the uphole end of the rotor 60, which provides a third restriction point for the flow path. The flow path then enters into expansion chamber 178 and is again diverted to flow between the journal bearing 150 and the primary seal cylinder 59, which provides a fourth restriction point. The mud then collects in expansion chamber 176, which provides a large volume increase thereby reducing the velocity of mud flow. A fifth restriction point is provided between the seal retention washer 155 and the primary seal cylinder 59. The mud flow path therefore changes direction at least six times, has five restriction points and collects in three expansion chambers 177, 178, 176 before reaching primary seal 54. The restrictive points, directional changes, and volume changes of the tortuous flow path reduce the momentum of the drilling mud and therefore reduce the velocity of flow of the drilling mud in the flow path before the mud reaches the primary seal 54.

In alternative embodiments, the tortuous drilling mud flow path may have an increased or decreased number of directional changes, restriction points and/or expansion chambers to those shown in FIG. 7. In further alternative embodiments, a tortuous flow path may be defined between the downhole end of the pressure compensated housing 36 of the driveshaft subassembly 22 and the uphole end of the rotor 60 without the need for the journal bearing 150 and/or the journal bearing housing 151. The innovative aspects of the invention apply equally in embodiments such as these.

Frictional losses, known as Moody-type friction losses, occur as the drilling mud flows along the flow path reducing the energy of mud flow. In addition, the tortuous nature of the flow path may provide additional minor energy losses to the mud flowing through the flow path. The energy losses resulting from the tortuous flow path can be quantified by a dimensionless loss coefficient K which is usually given as a ratio of the head loss $$h_m = \frac{\Delta\rho}{pg}$$

to the velocity head $$\frac{v^2}{2g}$$

through the area of concern:

$$K = \frac{h_m}{V^2/(2g)} = \frac{\Delta\rho}{\frac{1}{2}\rho V^1}$$

The total head loss $\Delta h_{tot}$ of a system can be determined by separately summing all losses, namely frictional $h_f$ and minor $h_m$ losses as follows:

$$\Delta h_{tot} = h_f + \Sigma h_m$$

Calculation of these energy losses is generally known in the art.

The energy losses from frictional losses and from the tortuous nature of the drilling mud flow path typically result in essentially stagnant or slow moving drilling mud reaching the primary seal 54, which beneficially reduces wear of the primary seal 54. The primary seal cylinder 59, primary seal 54 and other parts of the primary seal assembly (for example, the seal retention washer 155 and washer retention ring 156) are strategically positioned near the end of the tortuous flow path where the velocity of flow of drilling mud is reduced instead of being positioned in the fast flowing drilling mud at the beginning of the tortuous flow path. The primary seal cylinder 59, primary seal 54 and other parts of the seal assembly are also positioned uphole of the entry point of drilling mud into the MWD tool, therefore the drilling mud must flow uphole against gravity and in the opposite direction of the general mud flow in order to reach these components, which beneficially reduces wear of the primary seal cylinder 59, primary seal 54 and other parts of the primary seal assembly, thereby increasing their life.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. For example, while the MWD tool 20 has generally been described as being orientated with the pressure pulse generator 30 at the downhole end of the tool, the tool may be orientated with the pressure pulse generator 30 at the uphole end of the tool. The innovative aspects of the invention apply equally in embodiments such as these.

The invention in its broader aspects is therefore not limited to the specific details, representative apparatus and methods, and illustrative examples shown and described. Accordingly, departures may be made from such details without departing from the spirit or scope of the general concept.

The invention claimed is:

1. A back up seal assembly for a fluid pressure pulse generating apparatus comprising a driveshaft, an apparatus housing surrounding the driveshaft and a primary seal for sealing against the driveshaft to seal an opening in the apparatus housing, the back up seal assembly comprising:

(a) a seal assembly housing separate to the apparatus housing with a longitudinally extending bore therethrough for receiving the driveshaft; and (b) a back up seal enclosed by the seal assembly housing and configured to surround and seal against a portion of the driveshaft to allow rotation of the driveshaft while preventing lubricating liquid on one side of the back up seal mixing with lubricating liquid on the other side of the back up seal.

2. The back up seal assembly of claim 1, wherein the seal assembly housing comprises a first section and a second section configured to releasably mate with the first section.

3. The back up seal assembly of claim 1, further comprising a thrust bearing enclosed by the seal assembly housing and configured to surround a portion of the driveshaft.

4. The back up seal assembly of claim 1, further comprising a first thrust bearing and a second thrust bearing, the first and second thrust bearings being enclosed by the seal assembly housing and configured to surround a portion of the driveshaft, the first thrust bearing positioned on one side of the back up seal and the second thrust bearing positioned on an opposed side of the back up seal.

5. The back up seal assembly of claim 1, further comprising a spring enclosed by the seal assembly housing and positioned longitudinally adjacent and in communication with the back up seal for spring loading of the back up seal.

6. A driveshaft unit for a fluid pressure pulse generating apparatus comprising:

(a) a longitudinally extending cylindrical driveshaft with a first end for connection with a fluid pressure pulse generator of the fluid pressure pulse generating apparatus and an opposed second end for connection with a pulse generating motor of the fluid pressure pulse generating apparatus; and (b) the back up seal assembly of claim 1 surrounding a portion of the driveshaft.

7. The driveshaft unit of claim 6, wherein the driveshaft comprises:

(a) a first sealing surface for sealing with a primary seal to prevent external fluid from entering the fluid pressure pulse generating apparatus; and (b) a second sealing surface between the first sealing surface and the second end for sealing the back up seal of the back up seal assembly.

8. The driveshaft unit of claim 7, wherein the first sealing surface, the second sealing surface or both the first and second sealing surfaces comprise a cylinder fitted on the driveshaft.

9. The driveshaft unit of claim 8, wherein the cylinder is configured to releasably fit on the driveshaft.

10. The driveshaft unit of claim 8, wherein the cylinder comprises ceramic or carbide.

11. The driveshaft unit of claim 8, wherein the driveshaft further comprises an annular shoulder against which the cylinder abuts.

12. A pulser assembly for a fluid pressure pulse generating apparatus comprising:

(a) a housing:

(b) a pulse generating motor enclosed by the housing:

(c) a longitudinally extending cylindrical driveshaft with a first end for connection with a fluid pressure pulse generator of the fluid pressure pulse generating apparatus and an opposed second end coupled with the pulse generating motor;

(d) a primary seal cylinder surrounding a portion of the driveshaft, the primary seal cylinder configured to releasably fit on the driveshaft; and (e) a primary seal surrounding and sealing against the primary seal cylinder to seal an opening in the pulser assembly housing preventing drilling fluid from entering the housing and lubrication liquid from leaving the housing when the fluid pressure pulse generating apparatus is positioned downhole.

13. The pulser assembly of claim 12, wherein the primary seal cylinder comprises ceramic or carbide.

14. The pulser assembly of claim 12, wherein the driveshaft further comprises an annular shoulder against which the primary seal cylinder abuts.

15. The pulser assembly of claim 12, further comprising: a back up seal cylinder surrounding a portion of the driveshaft between the primary seal cylinder and the second end; and the back up seal surrounding and sealing against the back up seal cylinder to prevent lubricating liquid on one side of the back up seal mixing with lubricating liquid on the other side of the back up seal.

16. The pulser assembly of claim 15, wherein the back up seal cylinder is configured to releasably fit on the driveshaft.

17. A fluid pressure pulse generating apparatus for downhole drilling comprising:

(a) a fluid pressure pulse generator;

(b) a motor subassembly comprising a motor subassembly housing that houses a motor and a gearbox;

(c) a driveshaft subassembly comprising a driveshaft subassembly housing that houses a driveshaft extending from the motor out of the driveshaft subassembly housing and coupling with the fluid pressure pulse generator;

(d) a primary seal surrounding a portion of the driveshaft and configured to prevent drilling fluid from entering the driveshaft subassembly housing and lubrication liquid from leaving the driveshaft subassembly housing when the fluid pressure pulse generating apparatus is positioned downhole; and (e) a back up seal assembly enclosed by the driveshaft subassembly housing and comprising a seal assembly housing with a longitudinally extending bore therethrough for receiving the driveshaft, and a back up seal enclosed by the seal assembly housing and configured to surround a portion of the driveshaft and prevent lubricating liquid on one side of the back up seal mixing with lubricating liquid on the other side of the back up seal.

18. The apparatus of claim 17, further comprising a journal bearing surrounding a portion of the driveshaft between the coupling with the pressure pulse generator and the primary seal.

19. The apparatus of claim 18, further comprising a journal bearing housing enclosing the journal bearing, the journal bearing housing configured to releasably mate with the driveshaft subassembly housing.

20. The apparatus of claim 18, further comprising a primary seal cylinder fitted on a portion of the driveshaft such that the primary seal seals against an outer surface of the primary seal cylinder and the journal bearing aligns with the outer surface of the primary seal cylinder with a gap between the outer surface of the primary seal cylinder and an external surface of the journal bearing.

21. The apparatus of claim 20, wherein the primary seal cylinder is configured to releasably fit on the driveshaft.

22. The apparatus of claim 21, wherein the driveshaft comprises a first annular shoulder and the primary seal cylinder is positioned between the first annular shoulder and the fluid pressure pulse generator to releasably secure the primary seal cylinder on the driveshaft.

23. The apparatus of claim 17, further comprising a back up seal cylinder fitted on a portion of the driveshaft such that the back up seal seals against an outer surface of the back up seal cylinder.

24. The apparatus of claim 23, wherein the back up seal cylinder is configured to releasably fit on the driveshaft.

25. The apparatus of claim 24, wherein the seal assembly housing comprises a first section and a second section configured to releasably mate with the first section, wherein the driveshaft comprises a second annular shoulder and the back up seal cylinder is positioned between the second annular shoulder and an internal surface of seal assembly housing to releasably secure the back up seal cylinder on the driveshaft.

26. The apparatus of claim 25, further comprising a retention nut surrounding a portion of the driveshaft and configured to releasably secure the first section and the second section of the seal assembly housing together so as to releasably secure the back up seal cylinder on the driveshaft.

27. The apparatus of claim 17, wherein the seal assembly housing comprises a first section and a second section configured to releasably mate with the first section.

28. The apparatus of claim 17, further comprising a thrust bearing surrounding a portion of the driveshaft and enclosed by the seal assembly housing.

29. The apparatus of claim 17, further comprising a first thrust bearing surrounding a portion of the driveshaft on one side of the back up seal and a second thrust bearing surrounding a portion of the driveshaft on an opposed side of the back up seal, the first and second thrust bearings being enclosed by the seal assembly housing.

30. The apparatus of claim 17, further comprising a spring positioned longitudinally adjacent and in communication with the back up seal for spring loading the back up seal.

31. The apparatus of claim 17, wherein the lubrication liquid in the driveshaft subassembly has a different composition to the lubrication liquid in the motor subassembly.

32. The apparatus of claim 31, wherein the lubrication liquid in the driveshaft subassembly has a higher viscosity than the lubrication liquid in the motor subassembly.

33. The apparatus of claim 31, wherein the lubrication liquid in the driveshaft subassembly has a lower thermal expansion than the lubrication liquid in the motor subassembly.

34. A fluid pressure pulse generating apparatus for downhole drilling comprising:

(a) a fluid pressure pulse generator comprising a stator and a rotor;

(b) a pulser assembly comprising a pulser assembly housing that houses a motor and a driveshaft extending from the motor and coupling with the rotor for rotating the rotor relative to the stator to generate fluid pressure pulses in fluid flowing through the fluid pressure pulse generator;

(c) a seal surrounding and sealing against a portion of the driveshaft to seal an opening in the pulser assembly housing preventing drilling fluid from entering the pulser assembly housing and lubrication liquid from leaving the pulser assembly housing when the fluid pressure pulse generating apparatus is positioned downhole; and (d) a journal bearing surrounding a portion of the driveshaft between the coupling with the rotor and the seal.

35. The apparatus of claim 34, further comprising a journal bearing housing enclosing the journal bearing, the journal bearing housing configured to releasably mate with the pulser assembly housing.

36. The apparatus of claim 34, further comprising a cylinder fitted on a portion of the driveshaft such that the seal seals against an outer surface of the cylinder and the journal bearing aligns with the outer surface of the cylinder with a gap between the outer surface of the cylinder and an external surface of the journal bearing.

37. The apparatus of claim 36, wherein the cylinder is configured to releasably fit on the driveshaft.

38. The apparatus of claim 37, wherein the driveshaft comprises a first annular shoulder and the cylinder is positioned between the first annular shoulder and the rotor to releasably secure the cylinder on the driveshaft.

39. A fluid pressure pulse generating apparatus for downhole drilling comprising:

(a) a fluid pressure pulse generator;

(b) a motor subassembly comprising a motor subassembly housing that houses a motor;

(c) a driveshaft subassembly comprising a driveshaft subassembly housing that houses a driveshaft extending from the motor and coupling with the fluid pressure pulse generator;

(d) a primary seal surrounding and sealing against a portion of the driveshaft to seal an opening in the driveshaft subassembly housing preventing drilling fluid from entering the driveshaft subassembly housing and lubrication liquid from leaving the driveshaft subassembly housing when the fluid pressure pulse generating apparatus is positioned downhole; and (e) a back up seal assembly enclosed by the driveshaft subassembly housing and comprising a seal assembly housing with a longitudinally extending bore therethrough that receives the driveshaft, and a back up seal enclosed by the seal assembly housing, the back up seal surrounding and sealing against a portion of the driveshaft allowing rotation of the driveshaft and preventing lubricating liquid on one side of the back up seal mixing with lubricating liquid on the other side of the back up seal.

* * * * *